US006401333B1

(12) United States Patent
Suzuki et al.

(10) Patent No.: US 6,401,333 B1
(45) Date of Patent: Jun. 11, 2002

(54) METHOD AND DEVICE FOR THREE-DIMENSIONAL ARRANGEMENT OF WIRE AND METHOD OF MANUFACTURING CONDUCTIVE MATERIAL

(75) Inventors: Tomio Suzuki, Yokkaichi; Ritsu Tanaka, Nagoya, both of (JP)

(73) Assignee: NGK Insulators, Ltd., Nagoya-city (JP)

( * ) Notice: Subject to any disclaimer, the term of this patent is extended or adjusted under 35 U.S.C. 154(b) by 0 days.

(21) Appl. No.: 09/581,057

(22) PCT Filed: Oct. 15, 1999

(86) PCT No.: PCT/JP99/05718

§ 371 (c)(1),
(2), (4) Date: Jun. 8, 2000

(87) PCT Pub. No.: WO00/25956

PCT Pub. Date: May 11, 2000

(30) Foreign Application Priority Data

| | | |
|---|---|---|
| Nov. 2, 1998 | (JP) | 10-312556 |
| Nov. 2, 1998 | (JP) | 10-312557 |
| Jun. 22, 1999 | (JP) | 11-175066 |

(51) Int. Cl.[7] ..... H01K 3/22

(52) U.S. Cl. ..... 29/848; 29/605; 242/445.1; 242/447.3; 242/443

(58) Field of Search ..... 29/848, 847, 846, 29/850, 605, 596; 140/93.12, 92.2; 242/445.1, 447.3, 443, 432.5

(56) References Cited

U.S. PATENT DOCUMENTS 5,364,276 A 11/1994 Inasaka

FOREIGN PATENT DOCUMENTS

| | | |
|---|---|---|
| JP | 59-203385 | 11/1984 |
| JP | 6-76909 | 3/1994 |
| JP | 8-31873 | 2/1996 |

*Primary Examiner*—Peter Vo
*Assistant Examiner*—Minh Trinh
(74) *Attorney, Agent, or Firm*—Burr & Brown

(57) ABSTRACT

A method and apparatus (10) are used for manufacturing a wire structure wherein a wire (13) is three-dimensionally aligned at prescribed pitches. The method comprises the steps of providing one or more frame bodies (12) which have a prescribed thickness, peripherally of a rotary shaft (11). By rotating rotary shaft (11) about a rotation axis thereof, wires (13) are wound, at prescribed pitches, around frame bodies (12). Another frame body (12) is stacked on at least one existing frame body and wire (13) is wound thereon at prescribed pitches. The above steps are repeated to yield a wire structure having a wire aligned three-dimensionally and accurately at prescribed pitches.

20 Claims, 11 Drawing Sheets

FIG.10(a)
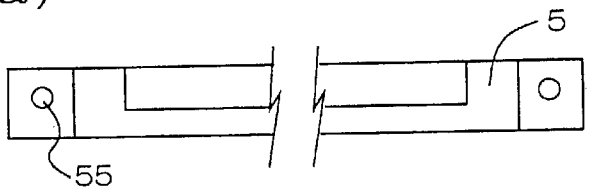
FIG.10(b)
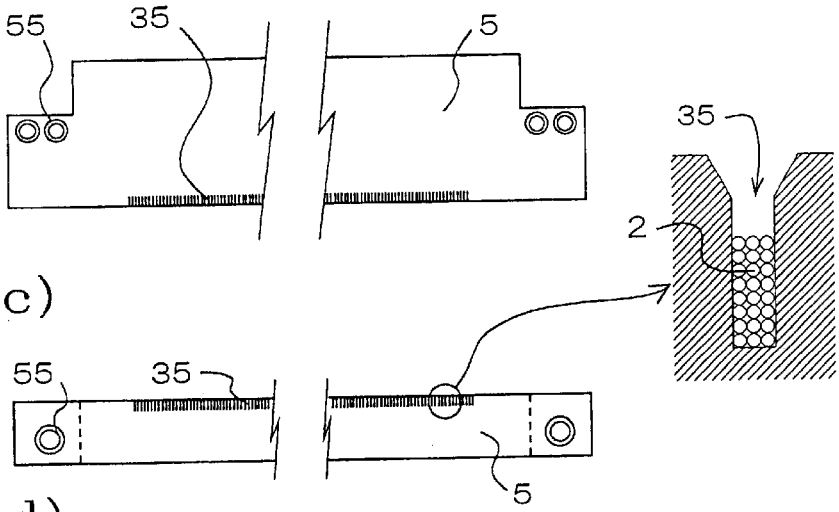
FIG.10(c)
FIG.10(d)
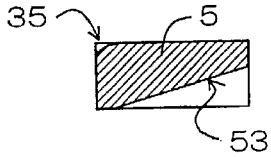
FIG.11
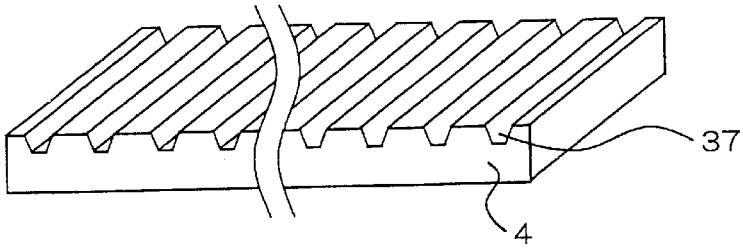

METHOD AND DEVICE FOR THREE-DIMENSIONAL ARRANGEMENT OF WIRE AND METHOD OF MANUFACTURING CONDUCTIVE MATERIAL

TECHNICAL FIELD

The present invention relates to a method of three-dimensional wire alignment and an apparatus therefor for manufacturing a wire structure wherein the wire is aligned three-dimensionally at prescribed pitches, and also to a method of manufacturing electrically conductive materials such as printed circuit board materials or anisotropic conductive materials using the wire structure.

BACKGROUND ART

Manufacturing wire structures wherein electrically conductive wires are aligned three dimensionally and accurately at prescribed pitches is an important technology for manufacturing an anisotropic conductive material comprising a wire structure embedded into rubber or resins. Anisotropic conductive materials are used as members for printed circuit board materials or the like wherein the electrodes on a device and on a distributing board are connected facing with respect to each other. In this case, electricity is conducted only between electrodes along the wires, and is insulated in the direction horizontally of the device or the distributing board. By taking advantage of such characteristics, anisotropic conductive materials have been widely used as wiring members for calculators, liquid crystal devices, and so on.

The printed circuit board includes a slot for receiving an integrated circuit and a group of connecting terminals for variety of electronic components on one side, and a printed conductive path for connecting components on the other side, which has been traditionally used in quantity as a constituent member for electronic equipment.

Conventionally, materials used for printed circuit boards have been manufactured by the steps of manufacturing a plate body made of insulating materials such as epoxy resin or glass, forming a through hole for conduction of electricity at a prescribed location by drilling operation, coating the through hole for conduction of electricity with a conductive metal such as copper by means of plating operation, and then sealing the through hole with a sealing agent.

However, there are recognized disadvantages in that drilling on the plate body produces chips during the process, which may lead to product defects, and that plating is subject to cracks at the edge portion of the board material, which may lead to faulty conductivity. In addition, the ratio of the length of the through hole (thickness of the board) to the diameter of the hole is limited to about 5 for drilling, and therefore, the lower limit of diameters of through holes for boards of 1 mm in thickness will be about 0.2 mm. However, smaller diameters are preferable for obtaining a printed circuit board of high densities, which has been difficult to obtain by drilling.

A circuit board manufactured using the steps of inserting electric wires, such as Ni or Co, into a frame body, pouring an insulating material such as molten epoxy resin or the like therein, cutting it along a plane perpendicular to the metal wires after the resin is hardened, and connecting both cut planes electrically is presented (see Japanese Unexamined Patent Application Publication No. 49-8759).

However, since an epoxy resin or the like is used in this circuit board, there has been a disadvantage in that accuracy in dimension such as a pitch of the through holes may be impaired due to volumetric shrinkage of about 2 to 3% in the process of the curing of the resin. This is a serious disadvantage since accuracy in dimension is a very important factor in a high-density printed circuit board.

In addition, in this type of circuit board, a difference of the thermal expansion between the circuit board material and conductive layers laminated on one or both sides thereof (photo process layer) is not considered, and thus, separation between board materials and conductive layers may occur due to the impact applied during service or temperature variations. Separation may also occur between an insulating material and the metal wires.

In view of above described disadvantages of the prior art, it is an object of the present invention to provide a method of three-dimensional wire alignment and an apparatus used therefor that enables manufacturing of large size wire structures as well as miniature wire structures wherein a wire is aligned three-dimensionally accurately at prescribed pitches, and that ensures high productivity and facility of handling.

It is another object of the present invention to provide a method of manufacturing conductive materials such as a printed circuit board material or an anisotropic conductive material wherein satisfactory electrical conductivity is established and the thermal expansion property may be controlled so that separation between a board material and a conductive layer, and between an insulating material and a metallic line (wire) during service can be prevented.

It is still another object of the present invention to provide a method of manufacturing conductive materials that enables the realization of a printed circuit board material or an anisotropic conductive material with higher density and improved dimensional accuracy conveniently and easily with improved workability.

SUMMARY OF THE INVENTION

According to the present invention, there is provided a first method for manufacturing a wire structure having a wire aligned three-dimensionally at prescribed pitches comprising the steps of disposing one or more frame bodies, which have a prescribed thickness, peripherally of a rotary shaft. Winding wires on the frame bodies at prescribed pitches in such a manner that the wire contacts at least one surface of the frame bodies by rotating the rotary shaft; and repeating steps of stacking another frame body on the above described frame bodies and winding wires thereon at prescribed pitches.

According to the present invention, there is also provided a second method for manufacturing a wire structure having a wire aligned three-dimensionally at prescribed pitches comprising the steps of disposing two separator plates, each having a prescribed thickness, at positions parallel to and spaced from a rotation axis of a rotary shaft. The wires are wound on the separator plates at prescribed pitches by rotating the rotary shaft about the rotation axis; and repeating steps of stacking subsequent sets of separator plates on the above described two separator plates and winding wires thereon at prescribed pitches.

According to the present invention, there is further provided a third method for manufacturing wire structures having wires aligned three-dimensionally at prescribed pitches comprising the steps of building a mold, either by disposing one or more frame bodies having a prescribed thickness on the periphery of the mold or by disposing two separator plates having a prescribed thickness on any one or two sides of the periphery of the mold, keeping a prescribed distance apart from one another. The wires are wound at prescribed pitches on the above described frame bodies or the separator plates building the mold by moving a wire bobbin around the mold, and repeating steps of stacking subsequent sets of frame bodies or separator plates on the above described frame bodies or the separator plates and winding a wire thereon at prescribed pitches.

According to the present invention, there is also provided a first apparatus for three-dimensional wire alignment comprising two side plates spaced apart and facing one another disposed along a direction perpendicular to a rotation axis of a rotary shaft defined therein. Two separator plates each having a prescribed thickness, are disposed at positions parallel to and spaced from the rotation axis. The apparatus also includes a driving means for rotating the side plates and separator plates about the rotation axis; and a wire bobbin for feeding a wire to be wound thereon at prescribed pitches from the side of the outer periphery of the two separator plates.

Preferably, in the above described method and apparatus for three-dimensional wire alignment, V-shaped grooves are formed on an end surface of the separator plates at prescribed pitches for aligning wire three-dimensionally and accurately.

According to the present invention, there is provided a second apparatus for three-dimensional wire alignment comprising a wire feeding mechanism, a spacer and a guide block for straining a wire, a mold for fixing the spacer and the guide block, and a rotary mechanism for rotating the mold. Groove portions for disposing the wire on the spacer are formed at prescribed pitches and prescribed depths, and guide blocks are provided with notched portions, at prescribed pitches, for defining the position of the wire and supporting the tensile strength of the wire.

Preferably, this apparatus for three-dimensional wire alignment is constructed in such a manner that as the spacers and the guide blocks are subsequently stacked, the distance between the spacer and the notches formed on the guide blocks becomes larger. It is also preferable that the apparatus is constructed in such a manner that the wire is strained between a plurality of groove portions positioned on an imaginary line extending almost straightly parallel with the stacking direction of the spacers and notched portions formed on the guide block when the spacers are stacked in the prescribed multiple layers.

It is also preferable that the guide block is provided with a bevel portion corresponding to the straining angle of the wire. The bevel portion prevents contact between the wire strained from the guide block and portions of the guide block other than the notched portions. It is further preferable to form the bottom portion of the notched portion in a profile having an obtuse angle or a curvature because it can prevent the wire from being broken due to extreme bending thereof.

When straining a wire, it is preferable to use a wire feeding mechanism that can control the wire feeding position by sliding itself in a direction parallel to the rotary shaft of the rotary mechanism, and therefore, a plurality of wires may be fed to the mold at one time. In order to achieve high productivity, it is preferred to use a mold having a symmetric structure about the rotary shaft of the rotary mechanism.

According to the present invention, there is provided a method for manufacturing a wire structure wherein the wire is strained three-dimensionally at prescribed pitches between groove portions and at pitches of the thickness of a spacer comprising steps of: using a wire feeding mechanism; a spacer provided with grooves formed at prescribed pitches and at prescribed depths for straining the wire by arranging it at prescribed pitches; a guide block provided with notched portions formed at prescribed pitches for defining the straining position of the wire and supporting the tensile strength of the wire; a mold for mounting the spacer and the guide block; and a rotary mechanism for rotating the mold; rotating the mold while adjusting the feeding position of the wire from the wire feeding mechanism so that the wire is received in the prescribed notched portions and the groove portions; and stacking the spacers and the guide blocks on the mold while suspending the rotation of the mold instantaneously.

Preferably, the guide block is disposed in such a manner so as to lessen the stress that is due to the tensile strength of the wire applied to the edge portion of the spacer to prevent the deformation of the spacer so that the accuracy of the position where the spacers are stacked is ensured.

According to the present invention, there is further provided a method for manufacturing a conductive material comprising the steps of: pouring an insulating material into a wire structure obtained by any one of the above described first to third methods of three-dimensional wire alignment or method of manufacturing the wire structure; curing the insulating material, and slicing the cured insulating material along the planes traversing the wire.

Preferably, the insulating material is any one of rubber, plastic, or plastic-ceramics composites.

BRIEF DESCRIPTION OF DRAWINGS

FIGS. 10 (*a*),(*b*),(*c*),(*d*) are explanatory drawings illustrating one embodiment of a guide block structure used for the apparatus for three-dimensional wire alignment shown in FIG. 7. FIG. 10(*a*) is a rear elevation, FIG. 10(*b*) is a plan view, FIG. 10(*c*) is a front view and an enlarged view of the notched portion, and FIG. 10(*d*) is a cross-sectional view.

FIG. 11 is a perspective view illustrating one embodiment of the spacer used for the apparatus for three-dimensional wire alignment shown in FIG. 7.

DETAILED DESCRIPTION OF THE INVENTION

The method of three-dimensional wire alignment according to the present invention may be generally classified into the following three methods:

1. A method of alignment comprising the steps of: disposing a frame body (flame shaped spacer) peripherally of a rotary shaft; winding a wire on the frame body by rotating the rotary shaft; repeating steps of stacking another frame body onto the above described frame bodies; and winding a wire again thereon.
2. A method of alignment comprising the steps of: disposing separator plates at positions parallel to and spaced apart from one another and parallel to and spaced apart from a rotation axis of a rotary shaft, winding a wire on the separator plates by rotating the rotary shaft about the rotation axis; repeating steps of stacking subsequent sets of separator plates on the above described separator plates and winding a wire again thereon.
3. A method of alignment in contrast to the above described first and second methods comprising the steps of: building a mold by disposing a frame body (frame shaped spacer) or separator plates; fixing the mold; winding a wire on the frame body or separator plates by moving a wire bobbin around the mold; and repeating steps of stacking subsequent sets of frame bodies or separator plates on the above described frame bodies or separator plates and winding a wire again thereon.

The present invention will be now described in detail according to embodiments, however, it is to be understood that the invention is not limited to the specific embodiments thereof.

Figure 1:
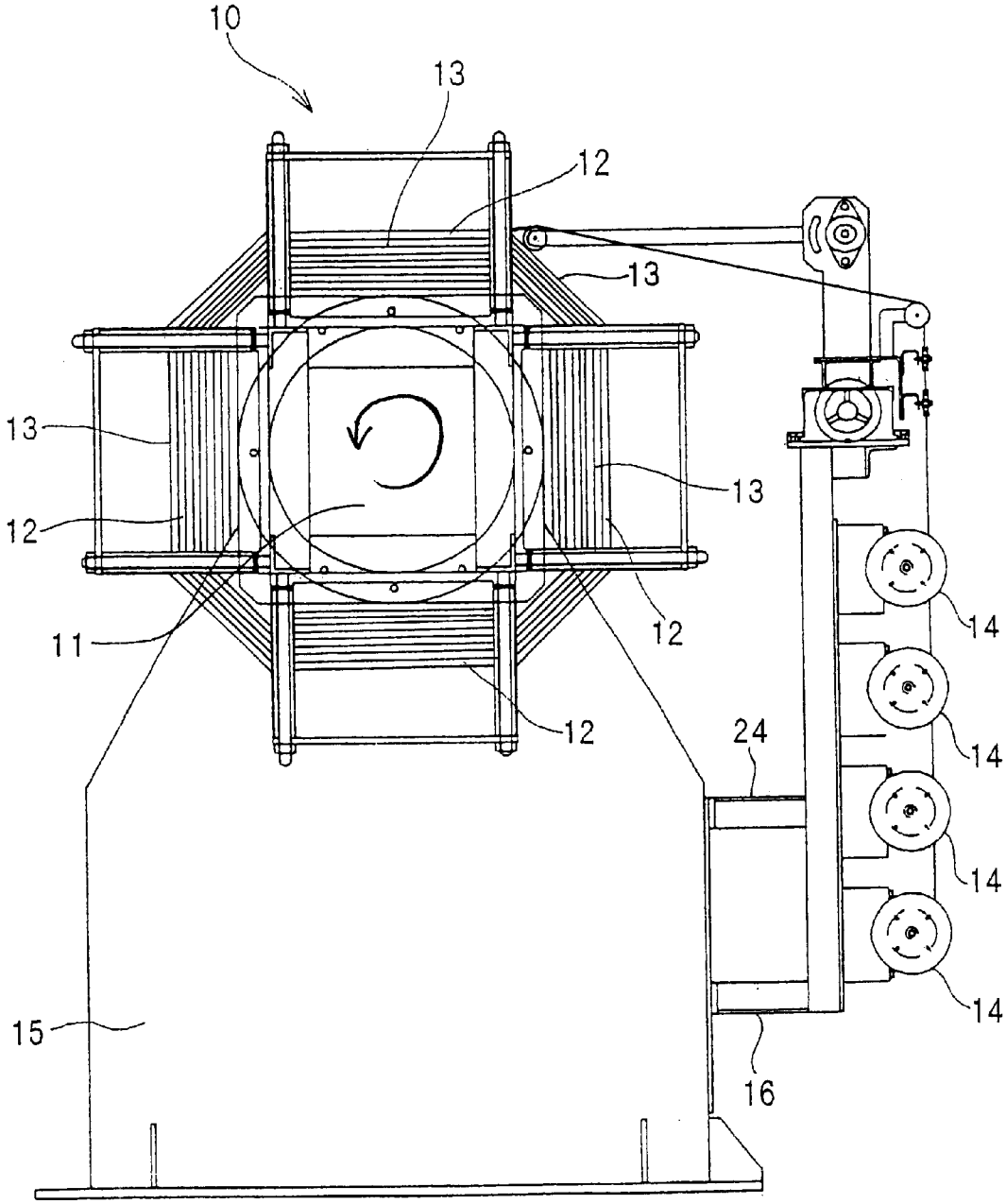
FIG. 1 is a schematic block diagram of the apparatus for implementing a method of three-dimensional wire alignment (first method of alignment) of one embodiment according to the present invention.
Figure 2:
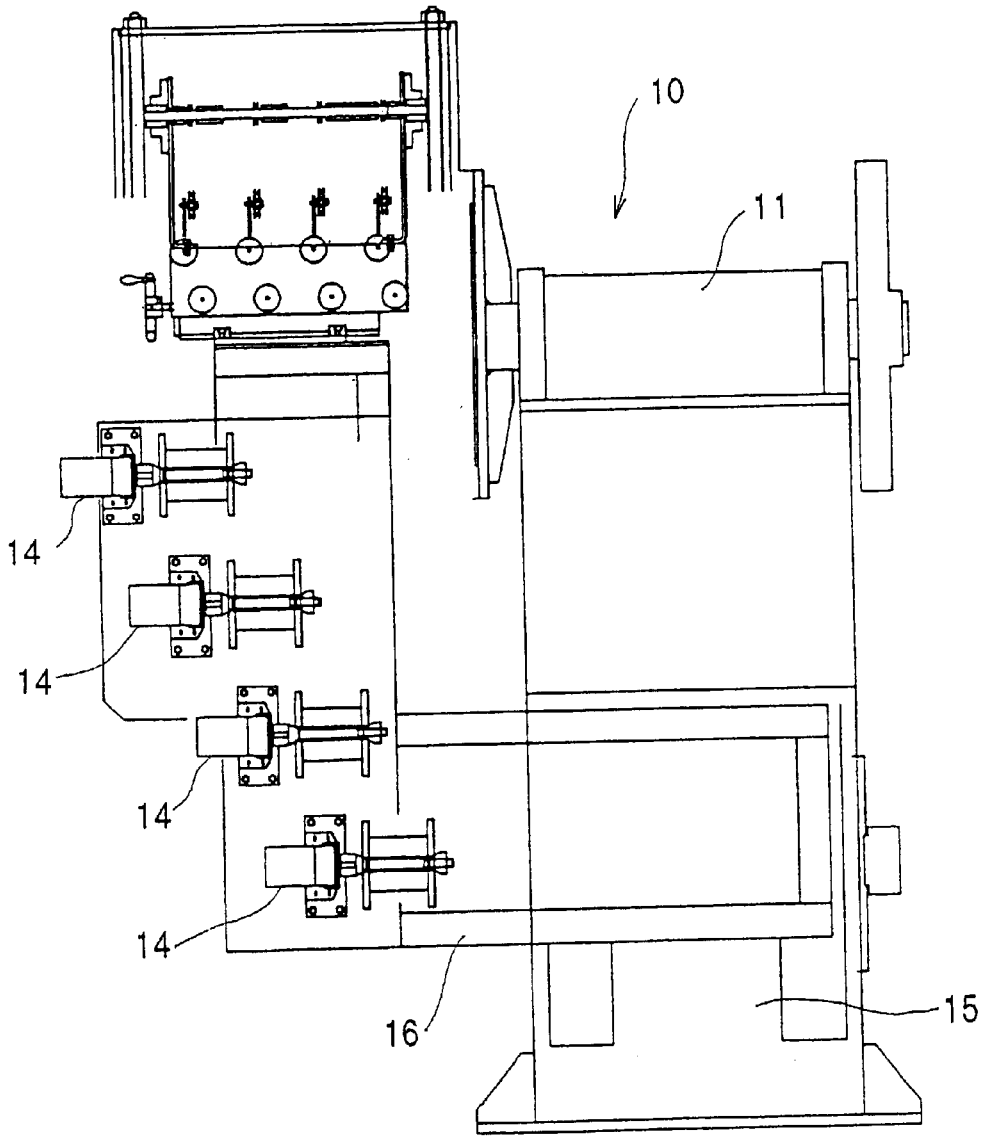
FIG. 2 is a side view of the apparatus shown in FIG. 1.

FIG. 1 is a schematic block diagram illustrating one embodiment of the apparatus for implementing the method of three-dimensional wire alignment according to the present invention, and FIG. 2 is a side view of the apparatus shown in FIG. 1.

Figure 3:
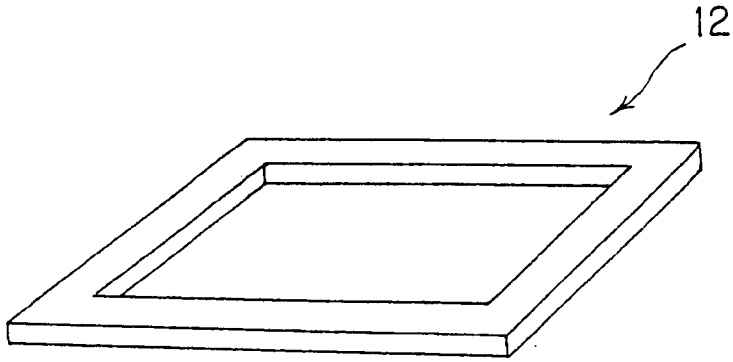
FIG. 3 is a perspective view illustrating one example of a frame body in accordance with the present invention.

The apparatus for three-dimensional wire alignment 10 comprises a rotary shaft 11 and four frame bodies (frame shaped spacers) disposed peripherally of the rotary shaft. The frame body 12 has a shape as shown in FIG. 3 and has a thickness corresponding to the pitch of wire 13 to be wound. On these four frame bodies 12 disposed peripherally of rotary shaft 11, wire 13 fed from wire bobbin 14 may be wound. When starting winding, wire 13 is fixed at the fixing portion (not shown) provided in the vicinity of the apparatus for three-dimensional wire alignment 10. Reference numeral 15 represents a base for supporting rotary shaft 11 and frame bodies 12 as well as four wire bobbins 14 via arm 16.

The wire 13 fed from wire bobbin 14 is wound on frame body 12 generally via a guide or the like which is not shown at prescribed pitches.

In the apparatus for three-dimensional wire alignment 10 having a construction shown above, wire 13 may be wound on frame body 12 by rotating rotary shaft 11 one turn by means of a motor, which is not shown, synchronized with the rotation of wire bobbin 14. Then subsequent sets of frame bodies 12 are stacked on existing frame bodies 12, and a wire 13 is wound on subsequent sets of frame bodies 12. These steps are repeated.

In this embodiment, since the apparatus comprising four frame bodies 12 disposed peripherally of rotary shaft 11 so that the cross-section taken along the axis is square in shape, the rotation of rotary shaft 11 is proceeded by 90°, and each time rotary shaft 11 rotates by 90°, steps of stacking frame bodies 12 and winding of wire 13 thereon are carried out. As a matter of course, the number of the frame bodies 12 peripherally of rotary shaft 11 are not limited to four, for example, there could be only one. However, it is preferable to dispose four frame bodies, because the cross-section taken along the axis will have the geometry of a square so that the wire structure may be manufactured through efficient use of the periphery of rotary shaft 11.

In this way, by repeating steps of stacking another frame body 12 thereon after every rotation of rotary shaft 11, and winding a wire 13 thereon at prescribed pitches, a wire structure having wire 13 aligned at prescribed pitches accurately and three-dimensionally may be obtained.

According to the steps described above, four wire structures as shown in FIG. 4 are obtained. After manufacturing four wire structures 17, the wire portions extending between each wire structure 17 are cut to remove each wire structure 17 from the periphery of rotary shaft 11, and four frame bodies 12 are disposed again peripherally of rotary shaft 11, and then the same steps as described above are repeated.

In the wire structure obtained in this way, since the wire is aligned accurately and three-dimensionally at prescribed pitches, a member that can conduct electricity only in one direction such as an anisotropic conductive material may be manufactured by embedding the wire structure into rubber or a resin and then cutting the structure into pieces of an appropriate size.

The second method of alignment and an apparatus therefore will now be described.

Figure 5:
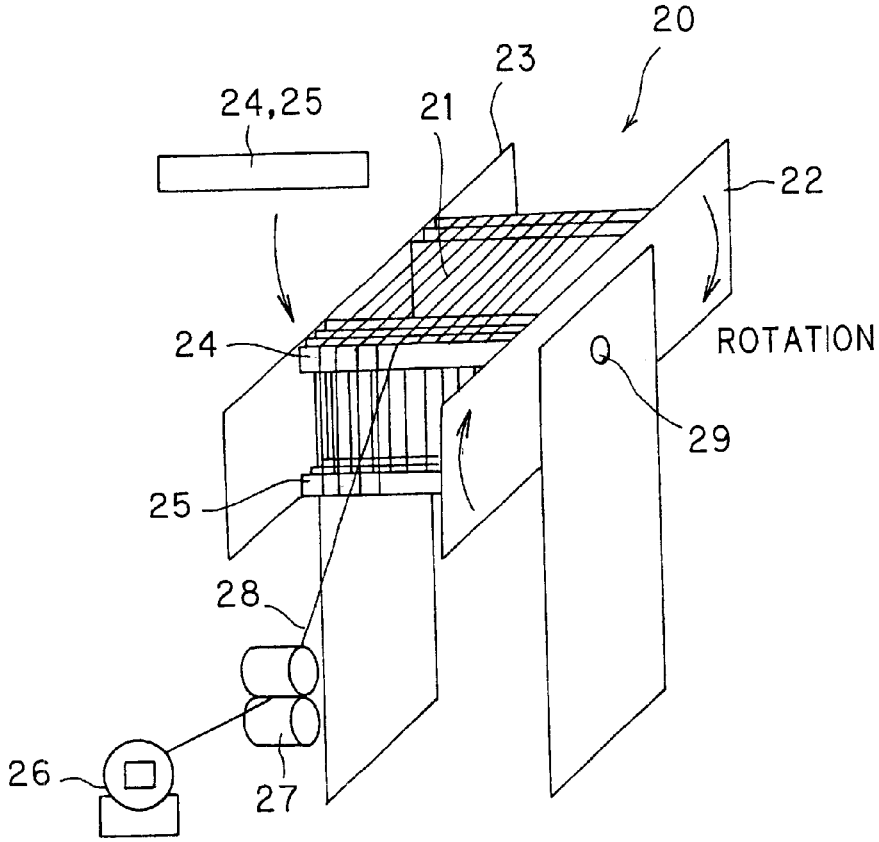
FIG. 5 is a schematic block diagram illustrating one embodiment of a method of three-dimensional wire alignment (second method of alignment) and an apparatus for three-dimensional wire alignment (first apparatus of alignment) for implementing the same according to the present invention.

FIG. 5 is a schematic block diagram illustrating one embodiment of the method for three-dimensional wire alignment (second method of alignment) and the apparatus for three-dimensional wire alignment (first apparatus of alignment) for implementing the same.

In FIG. 5, reference numeral 20 represents an apparatus for three-dimensional wire alignment. A prism space 21 is defined by two side plates 22 and 23 that face one another, disposed in a direction perpendicular to the axis of prism space 21, and two separator plates 24 and 25 having a prescribed thickness are disposed on one side of prism space 21 parallel with and spaced a prescribed distance from the axis of prism space 21.

The apparatus is constructed in such a manner that side plates 22, 23 and separator plates 24, 25 are rotated peripherally of the axis of prism space 21 via a driving means such as a motor, which is not shown here. On the side of the outer periphery of separator plates 24, 25, wire 28 is fed from wire bobbin 26 through guide 27 at prescribed pitches. Reference numeral 29 represents an axis of prism space 21.

Figure 6:
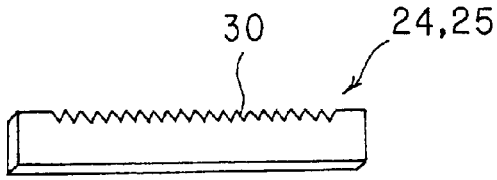
FIG. 6 is an explanatory drawing illustrating an example of a separator plate in accordance with the present invention.

FIG. 6 shows a preferred example of separator plates 24, 25, which are provided with V-shaped grooves 30 formed on end surfaces of separator plates 24 and 25, at prescribed pitches. This arrangement is preferable because the wire may be aligned accurately.

In the apparatus for three-dimensional wire alignment 20 having such a structure, two separator plates 24 and 25, each having a prescribed thickness, are disposed a prescribed distance apart from one another, such that prism space 21 is defined therbetween and prism space 21 is rotated about central axis 29 many turns.

As described above, by rotating prism space 21, that is, by rotating side plates 22, 23 and separator plates 24, 25 about central axis 29 many turns, a wire 28 is wound on two separator plates 24, 25 at prescribed pitches so that wire 28 is aligned over the surfaces thereof. Then, steps of staking another two separator plates on these two separator plates 24, 25, and winding a wire thereon at prescribed pitches again are repeated prescribed times.

In this way, a wire structure 17 (shown in FIG. 4) is obtained wherein the wire is wound at prescribed pitches accurately and three-dimensionally.

After the steps of manufacturing the wire structure, the wire outside separator plates 24, 25 is cut to remove the wire structure, and two additional separator plates are disposed a prescribed distance apart to define prism space 21 therebetween, and then the steps described above are repeated.

In the embodiment shown in FIG. 5, though one piece of the wire structure is manufactured, it is also possible to manufacture two pieces of wire structures using separator plates 24 and 25, which have prism space 21 defined therebetween. As described above, separator plates 24 and 25 face one another and are perpendicular to central axis 29.

Figure 4:
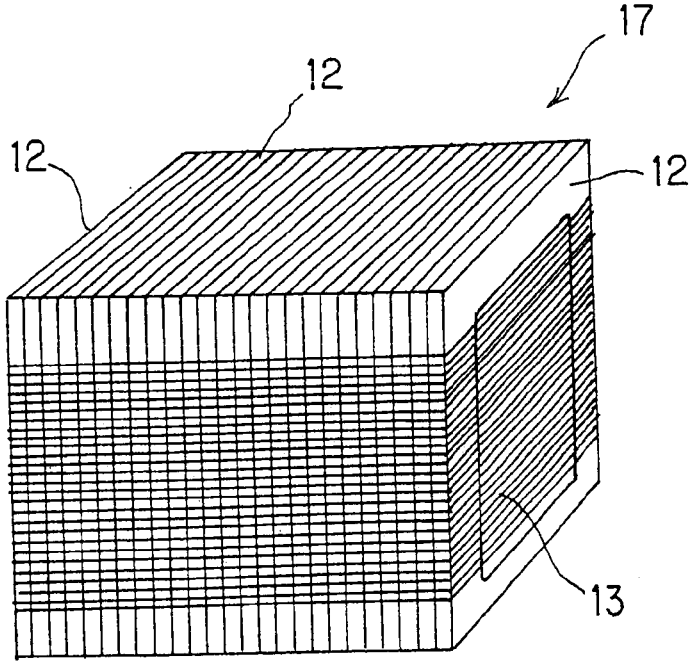
FIG. 4 is a perspective view illustrating one example of a wire structure in accordance with the present invention.

Though the third method of alignment is not described in detail, wire structure 17 having wire 28 aligned at prescribed pitches accurately and three-dimensionally (as shown in FIG. 4) is also obtained by a method wherein a mold is fixed and a wire bobbin is moved, which is a reversal of the first and second methods of alignment discussed above, comprising the steps of, for example, in FIG. 5, building a mold using side surface plates 22, 23 and separator plates 24, 25, which define prism space 21, and moving a wire bobbin 26 and a guide 27 around the mold.

An embodiment of an apparatus for three-dimensional wire alignment (second apparatus of alignment) will now be described.

Figure 7:
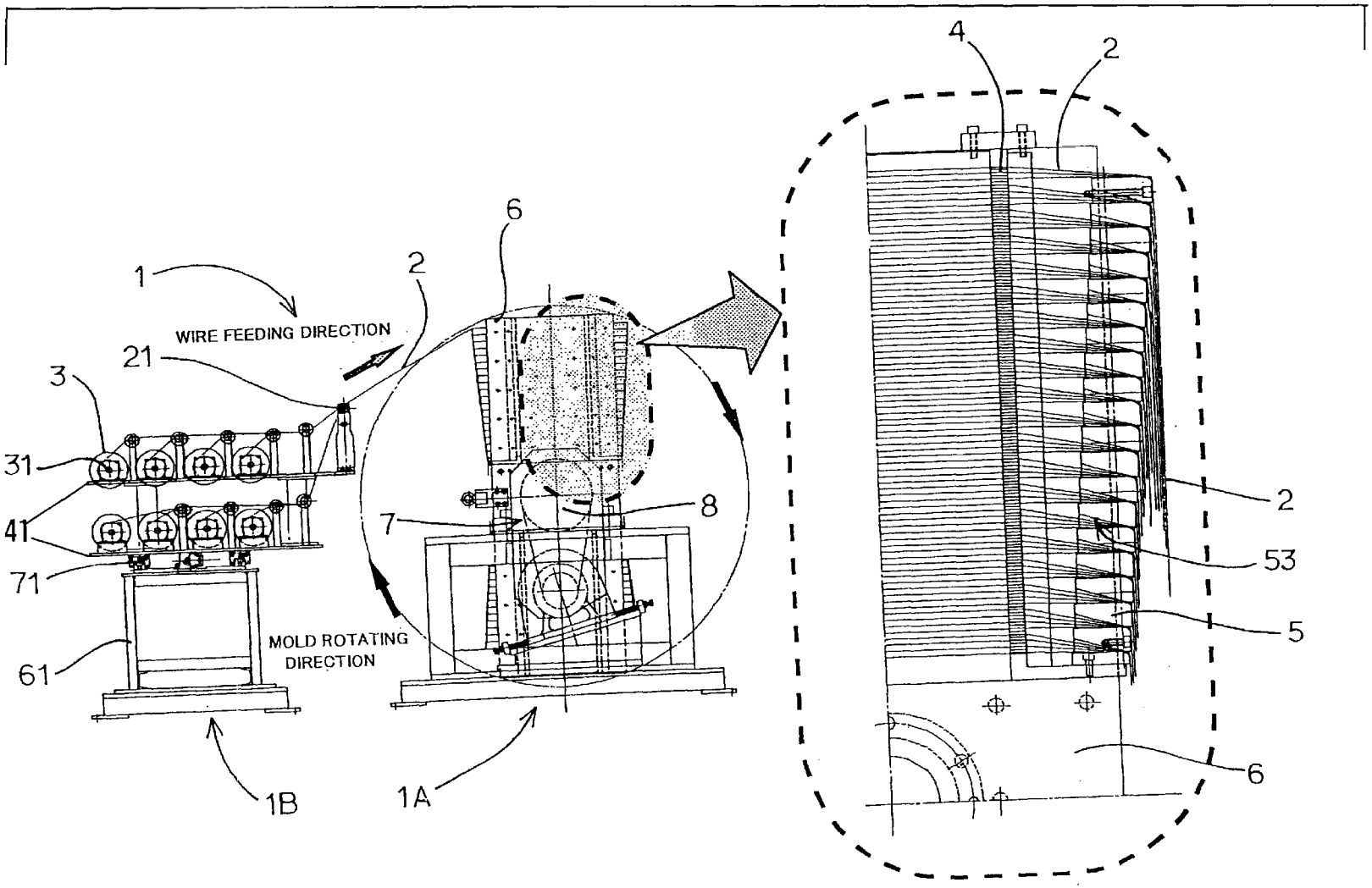
FIG. 7 is an explanatory drawing illustrating another embodiment of an apparatus for three-dimensional wire alignment (second apparatus of alignment) according to the present invention.

FIG. 7 is an explanatory drawing illustrating a second apparatus of alignment for three-dimensional wire alignment. (Hereinafter referred to as "apparatus of alignment"). The apparatus of alignment 1 comprises a main body 1A for manufacturing a wire structure, and a wire feeding mechanism 1B for feeding wire 2 to main body 1A. Of course, it may be formed as an integrated apparatus. FIG. 7 is accompanied by an enlarged cross sectional view of mainly guide block 5 to be stacked in main body 1A.

Figure 8:
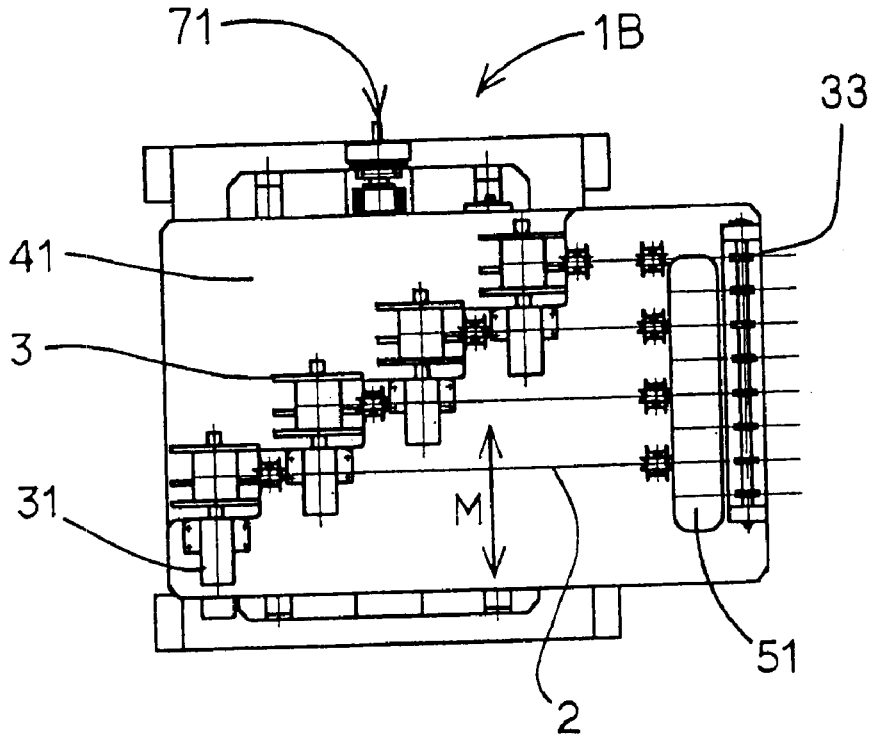
FIG. 8 is a plan view of the wire feeding mechanism shown in FIG. 7 viewed from the top of FIG. 7.

The plan view of wire feeding mechanism 1B of FIG. 7 viewed from the top of FIG. 7 is shown in FIG. 8. The wire feeding mechanism 1B comprises a wire bobbin 3 on which a wire is wound, a torque motor 31 for applying a tensile strength to wire 2, and a pulley 33 for feeding the wire from the prescribed position to main body 1A, and all these elements are disposed on the same base 41. The base 41 has, as shown in FIG. 7, two stages in the vertical direction, and wire 2 wound on bobbin 3 disposed on lower base 41 is fed through hole portion 51, formed on the upper base as shown in FIG. 8, to main body 1A via a pulley disposed in a row on upper base 41 at the prescribed location.

As shown in FIG. 7 and 8, base 41 comprising 2 stages is disposed on sliding mechanism 71 provided on the upper surface of supporting base 61. The sliding mechanism 71 allows base 41 to slide at prescribed pitches in a direction perpendicular to the wire feeding direction shown in FIG. 8, which is illustrated by the arrow M. The pulleys 33 disposed in a row are fixed at prescribed positions, and preferably the distance between each pulley 33 is set at an integral multiple of the pitch of grooves 37 formed on spacer 4, which will be described later, according to the disposing pitch of the wire in the wire structure to be manufactured.

On the other hand, main body 1A comprises a spacer 4 and a guide block 5 for straining wire 2, a mold 6 for mounting guide block 5, and a rotary mechanism 7 for rotating mold 6.

Figure 9:
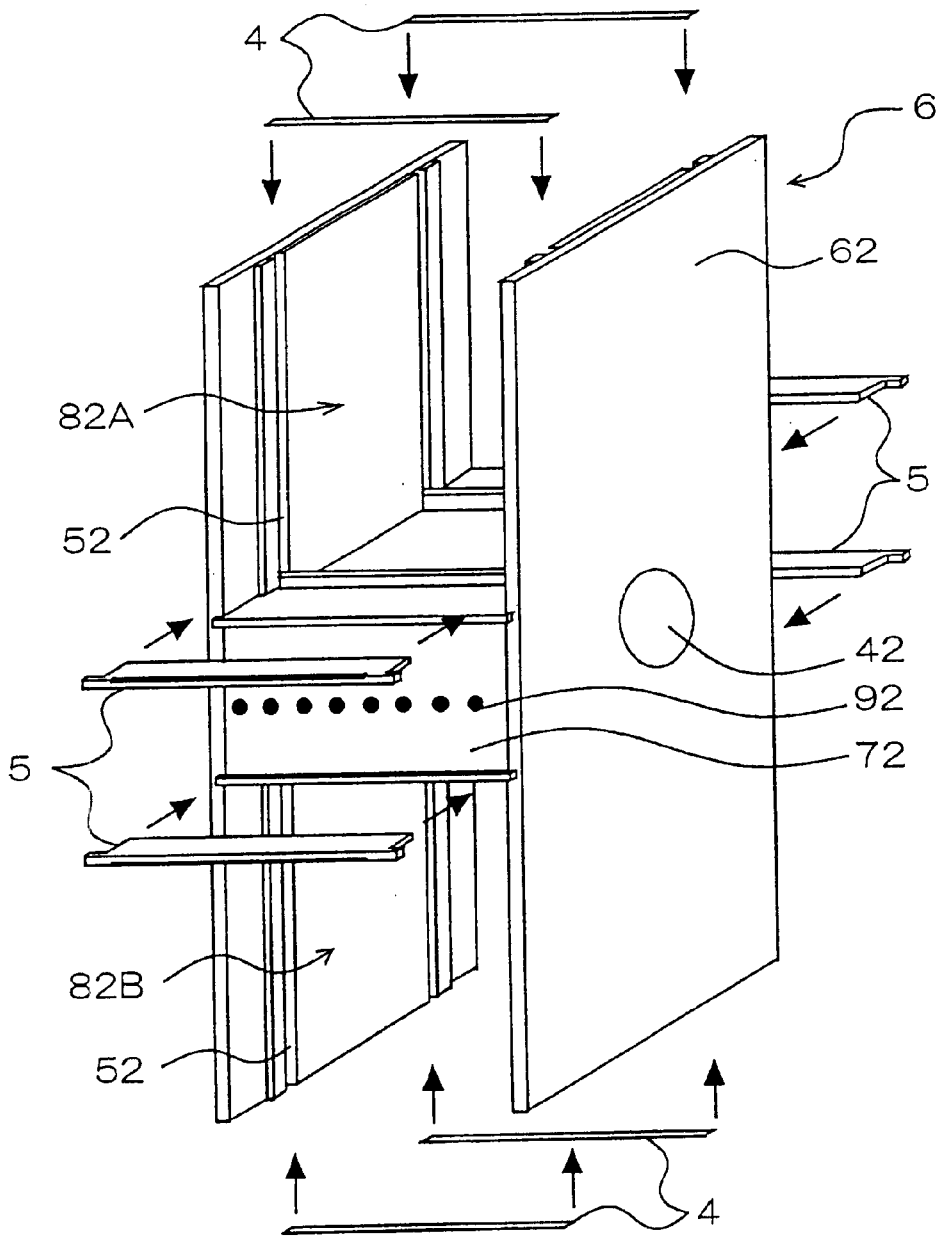
FIG. 9 is an explanatory drawing illustrating a structure of a molding used for the apparatus of wire alignment shown in FIG. 7.

FIG. 9 shows an explanatory drawing of the structure of mold 6 used in the apparatus of alignment 1 shown in FIG. 7 in detail.

FIG. 9 shows that mold 6 has an H-shaped cross section, and includes a mounting hole 42 for inserting rotary shaft 8 of rotary mechanism 7 in the center thereof. The mold 6 also includes side walls 62, each formed with positioning groove 52 for stacking spacer 4 at prescribed positions, and comprises two recess portions 82A and 82B defined by side walls 62 and bottom surface portion 72 having a mounting hole 42 formed thereon. The guide block 5 is secured to side walls 62 and/or the bottom surface portion 72 on the outside thereof by means of screws or the like.

The mold 6 has, assuming that mounting hole 42 is a central axis thereof, a configuration symmetry about the central axis, and the wire structure is formed in each recess portion 82A and 82B. Such recess portions formed on the mold used for the apparatus of alignment of the present invention are not limited to being formed at two positions, but may be formed at one position or three positions, for example. When using mold 6 having a plurality of recess portions, the length of the wire extending from one wire structure to another structure may be reduced so as to reduce the waste of wire.

By using rotary mechanism 7, when mold 6 is rotated in a prescribed direction, for example, clockwise as shown in FIG. 7, wire 2 is strained at a constant tensile strength through guide block 5 disposed on the upper right side first, then spacer 4 on the upper right side, and spacer 4 on the upper left side, then guide block 5 on the upper left side of main body 1A. The lower recess portion 82B of mold 6 then moves to the upper side thereof, wire 2 is tightened in recess portion 82B as in recess portion 82A. In this way, by performing the installation of spacer 4 and guide block 5 while suspending the revolution instantaneously during revolution of mold 6 by approximately a prescribed angle, a wire structure having a wire 2 strained at prescribed intervals may be obtained.

The detail structure and the method of straining wire 2 will be now described.

The guide block 5 and spacer 4 are mounted on mold 6 for the first stage (the lowest stage). The tip of wire 2 drawn from wire feeding mechanism 1B is fixed at a prescribed position by the use of the side surface of bottom surface portion 72 of mold 6 or the like, for example, at fixing point 92 shown in FIG. 9 by the use of a screw or other various means.

The mold 6 is rotated by approximately a prescribed angle to strain wire 2 to guide block 5 disposed on the side of fixed point 92 on one of recess portion 82A so that wire 2 is received in notched portion 35 formed on guide block 5. In the case where wire feeding mechanism 1B shown in FIG. 7 and FIG. 8, eight parallel portions of wire 2 are strained at prescribed distances simultaneously.

Explanatory drawings illustrating one embodiment of guide block 5 are shown in FIG. 10(*a*), (*b*), (*c*), and (*d*). FIG.

10(*a*) is a rear elevation, FIG. 10(*b*) is a plan view, FIG. 10(*c*) is a front view and an enlarged view of a notched portion 35, and FIG. 10(*d*) is a crow-sectional view, and guide block 5 is formed with notches 35 on the edge of a side 53 thereof at prescribed pitches. The wire is hooked on notch 35, and by further rotating mold 6, it is guided to groove portion 37 of spacer 4 so that wire 2 is received between notched portion 35 and groove portion 37.

FIG. 11 is a perspective view illustrating one embodiment of the structure of spacer 4. On the upper surface of spacer 4, groove portion 37 is formed at the same disposing pitches as that of notched portion 35 on guide block 5 along the direction in which the wire is strained. By straining the wire so as to be received in groove portion 37, the intervals between the portions of wire 2 strained on the upper surface of spacer 4 become constant so that the accuracy of the straining position of wire 2 is ensured.

Figure 13:
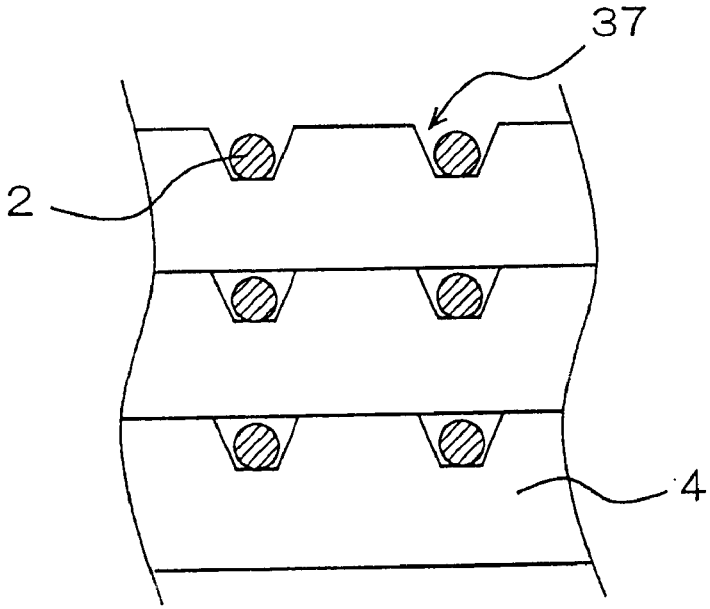
FIG. 13 is a cross-sectional view illustrating the state of spacer being stacked in the apparatus for three-dimensional wire alignment shown in FIG. 7.

As described later, since spacers 4 are stacked one one another, defining the depth of groove portion 37 larger than the diameter of wire 2 allows the upper and lower surfaces of spacers 4 to be in direct contact with one another when stacked, as shown in FIG. 13. In this way, the disposing pitch of wire 2 in the direction of stacking of spacer 4 is aligned correctly so that the straining accuracy of the wire is improved.

In order to maintain the straining accuracy of wire 2, accurate formation of groove portion 37 is required. As a method of forming groove portion 37, preferably, a chemical method such as chemical etching or the like, or a mechanical process such as dicing is used.

The wire 2 is received in groove portion 37, so as to be received in parallel, formed on another spacer 4 disposed in recess portion 82A, which allows the wire to be strained between spacers 4. In addition, wire 2 is guided to notched portion 35 formed on another guide block 5 disposed in recess portion 82A, and strained between another spacer and another guide block 5. The first wiring operation between guide blocks 5 in recess portion 82A is completed in this way. Then, mold 6 is rotated, wire 2 is strained between guide blocks 5 to complete the first wiring operation in recess portions 82A and 82B.

As described above, it is preferable that the intervals between wires 2 to be fed is an integral multiple of the disposing pitch of groove portion 37 formed on spacer 4 (the same disposing pitch as that of notches 35 formed on guide block 5) in wire feeding mechanism 1B. Therefore, when the disposing pitch of groove portion 37 and the spacing between pulleys are the same, the wire structure may be obtained by rotating mold 6 while disposing spacer 4 and guide block 5 adequately without sliding mechanism 71 of wire feeding mechanism 1B.

On the other hand, when the spacing between pulleys 33 is equal to or more than two times the disposing pitch of groove portion 37, the wire feeding position is adjusted by sliding base 41 by a disposing pitch of groove portion 37 after the wire is strained in recess portion 82B before wire 2 is strained in recess portion 82A again by the use of sliding mechanism 71 in wire supplying mechanism 1B so that the wire is guided to notched portion 35 and groove portion 37 adjacent to the notched portion and the groove portion where the wire is already strained.

After adjustment of the wire feeding position is performed, another eight parallel wires 2, which are parallel to eight wires 2 previously strained by rotating mold 6 one turn, are strained. Steps of adjusting the wire feeding position by sliding mechanism 71 and rotating mold 6 are repeated until all groove portions 37 formed on one spacer 4 are filled with wires 4. It is needless to say that, when such a sliding mechanism 71 is used, setting the first feeding position of wire 2 so that all groove portions 37 formed on one spacer 4 are filled with wires 2 is required.

After all grooves 37 of spacer 4 on the first stage are applied with wire 2, the second stage of spacer 4 is disposed. By moving sliding mechanism 71 in the opposite direction in which the wire is applied on the space of the first stage, the wire application on spacer 4 on the second stage is performed. In this way, steps of disposing spacer 4, adjusting the wire feeding position by sliding mechanism 71, and rotating mold 6 are repeated until a prescribed number of stages may be obtained.

The guide blocks 5 are required to be stacked corresponding to the stacking of spacers 4. Here, only one guide block 5 may be used for multiple stages of guide blocks 4. In other words, as shown in an explanatory drawing of FIG. 12, in spacers 4 stacked to a prescribed number of stages, it is possible to strain wire 2 between a plurality of groove portions 37 positioned on imaginary lines extending almost straightly parallel to the direction of stacking and a notched portion 35 formed on one guide block 5. In this way, by reducing the number of guide blocks 5 to be used, the cost for components may be reduced and the manufacturing operation of the wire structure may be simplified.

Of course, notch 35 must have sufficient depth and width to receive all wires 2, since a plurality of wires 2 are to be received therein. Previously described enlarged view of notched portion 35 of FIG. 10(*c*) illustrates the state where twenty-four pieces of wires 2 are received in notched portion 35. In other words, one guide block (single stage) 5 is used for spacers 4 stacked into twenty-four stages.

Figure 12:
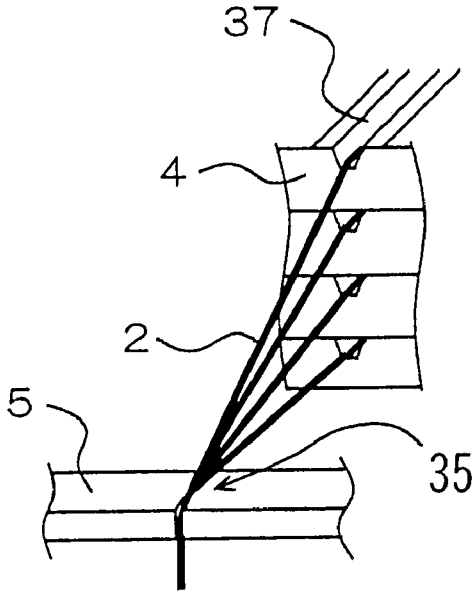
FIG. 12 is an explanatory drawing illustrating the state of the wire strained between multiple layers of spacers and a guide block in the apparatus for three-dimensional wire alignment shown in FIG. 7.

In this way, when a single stage of guide block 5 is used for multiple stages of spacers 4, as shown in FIG. 7 and FIG. 12, wires 2 present the state of spreading out at constant angles toward the stacking direction of spacers 4. Since a subsequent guide block 5 is disposed on the guide block 5 discussed above, if the subsequent guide block 5 comes into contact with previously strained wire 2 or causes wire 2 to be bent, the tensile force of wire 2 may vary, or wire 2 may be damaged or broken.

Therefore, according to the present invention, it is preferred to form a bevel portion on guide block 5 corresponding to the straining angle of wire 2 so that the wire strained to spacer 4 comes into contact with only notched portions 35 of guide block 5. As shown in an enlarged view of FIG. 7 and a cross-sectional view of FIG. 10(*d*), bevel portion 53 is formed on the lower surface of guide block 5.

In the case of the apparatus of alignment 1 shown in FIG. 7, wire 2 is applied to be bent at notched portion 35 at an angle of about 90 degrees. In this case, if the contour of the bottom portion of the notched portion has a sharp edge, wire 2 tends to be bent and broken at that edge portion. Therefore, as shown in FIG. 10(*d*), it is preferable that the bottom portion of notched portion 35 is formed in a profile having a plurality of obtuse angles combined or a curvature so that wire 2 is not bent excessively.

When stacking guide blocks 5 corresponding to the stacking of spacers 4, if notched portion 35 is positioned on an imaginary line parallel to the stacking direction of guide blocks 5 (the same direction as the stacking direction of spacers 4), wires 2 applied in recess portion 82A and 82B are overlapped on one another on the side surface of already disposed guide block 5.

In such a case, since wires 2 have a tendency not to run straight, there may occur problems such that the tensile force of wires 2 may slightly vary, or that wires may form a kink due to contact between wires 2 which may lead to breakage thereof. In addition, it may cause another problem such that, after manufacturing of the wire structure is complete, it may require much time and expense in cutting wires 2 when taking the wire structure out of mold 6.

In order to solve the problems described above, as shown in an enlarged view of FIG. 7, it is preferable to define the configuration and/or the stacking position of guide block 5 in such a manner that the distance between spacer 4 and notched portion 35 formed on guide block 5 becomes larger as the number of stacked guide blocks 5 increases.

This ensures that wire 2 is received in notched portion 35 and wires 2 are disposed approximately in parallel without overlapping one another between recess portion 82A and 82B, so that the straining accuracy of wire 2 is ensured and the cutting operation of wire 2 after the wire structure is manufactured may be facilitated.

Preferably the structure of guide block 5 is such that it is screwed to side wall 62 or the like of the previously mounted guide block 5 and/or mold 6 by the use of screw hole 55 or the like shown in FIGS. 10 (*a*) to (*d*) as it is stacked one after another so that the position thereof is fixed.

By using guide block 5 described above, wire 2 is prevented from being bent extremely at the edge portion of spacer 4, and thus the pressure applied by wires 2 is distributed without being concentrated in the edge portion so that spacer 4 may be kept free from deformation. This enables the stacking of multiple layers and the straining accuracy of wires 2 between spacers 4 is preferably maintained.

As described above, when steps of rotating mold 6, operating sliding mechanism 71, and stacking a prescribed number of spacers 4 and guide blocks 5 are performed in a prescribed order to obtain the straining of wire 2, the wire is cut off with the tensile strength kept constant. Maintaining the tensile strength of wire 2 may be achieved by forming a fixing point, for example, that is similar to fixing point 92 formed on mold 6, on guide block 5 disposed on the uppermost stage.

As a next step, as described above, after the wire structure is obtained by the use of the first to the third methods of three dimensional wire alignment or the first or the second apparatus of alignment, an insulating material such as rubber, plastic or plastic-ceramic composites is poured into the wire structure and cured.

Pouring of an insulating material into the wire structure is generally carried out by placing the wire structure into the mold and introducing the insulating material into the mold in a melted state. Preferably, pouring operation is carried out by a vacuum casting method.

Then, after the insulating material is cured and the frame body, the separator plate and the guide block and so on are removed, a composite block body 38 (shown in FIG. 14) having wires 34 disposed therein at prescribed pitches may be obtained.

Figure 14:
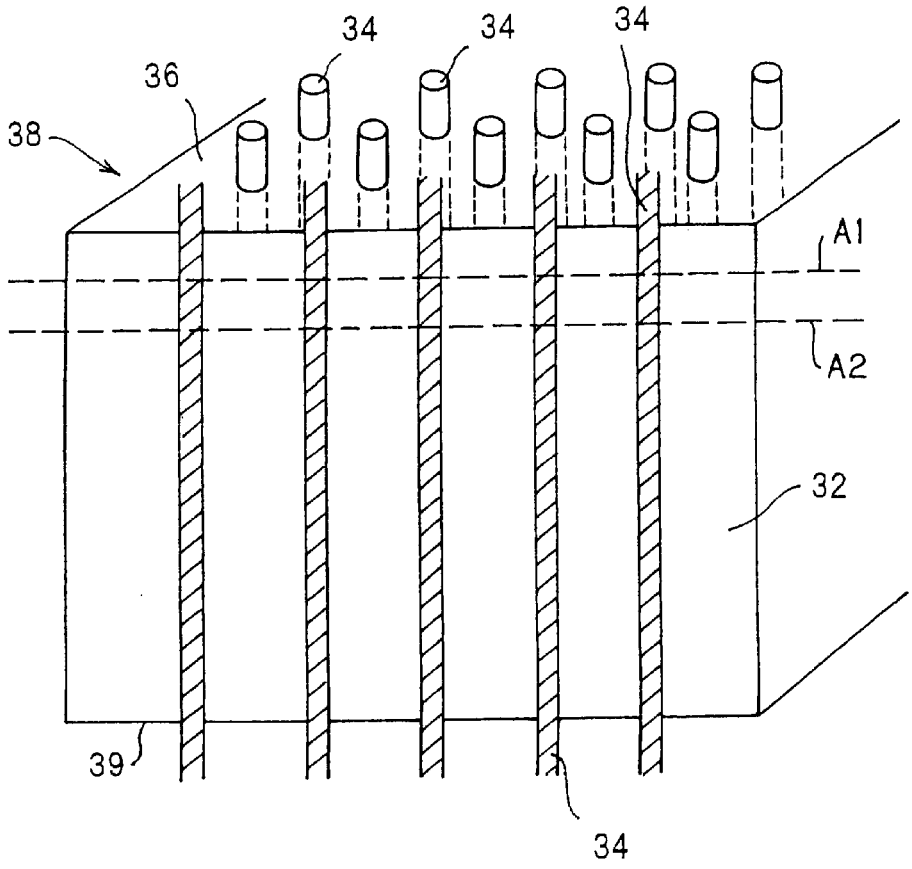
FIG. 14 is a partially perspective view illustrating one example of the composite block body manufactured according to the method of manufacturing a conductive material of the present invention.

In FIG. 14, composite block body 38 comprises an insulating material such as rubber, plastic, or a plastic-ceramic composites 32 having conductive wires 34 disposed at prescribed pitches.

The wires 34 are disposed in such a manner that they extend linearly from a surface 36 of composite block body 38 to an opposed surface 39, and project from surface 36 and opposed surface 39.

When such a composite block body 38 is obtained, composite block body 38 is sliced (cut) along surfaces A1, A2, which are perpendicular to wires 34 by means of a band saw, wire saw, or the like so that a conductive material such as a printed circuit board material or an anisotropic material may be obtained.

According to the method described above, since wires 34 may be arranged at prescribed intervals accurately in dimension, a printed circuit board material with wires 34 arranged at narrower pitches (high density), for example, at pitches of 1.27 mm or below may be obtained, and moreover, the crosstalk associated with narrower pitches may be minimized.

Figure 15:
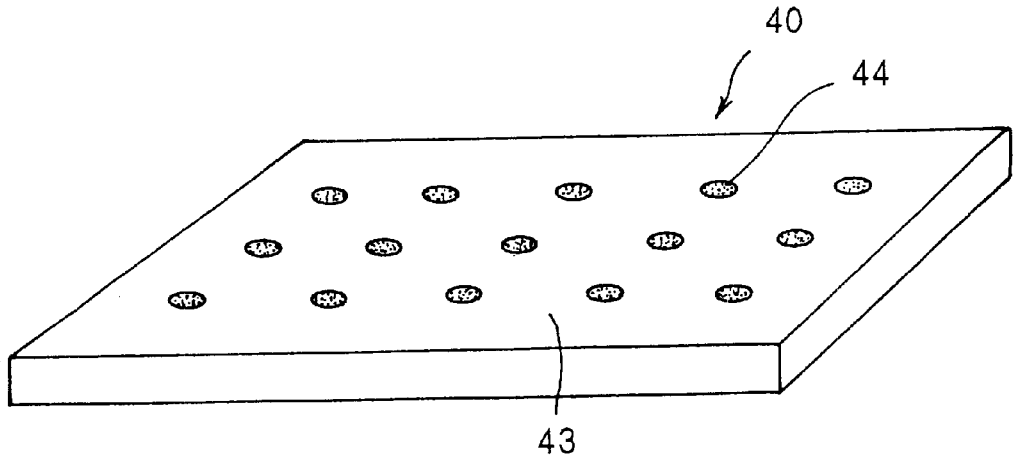
FIG. 15 is a perspective view illustrating one example of the printed circuit board material obtained by the method of manufacturing a conductive material according to the present invention.

FIG. 15 illustrates an example of a printed circuit board material manufactured according to the present invention. In FIG. 15, board material 40 is composed of plastic and ceramic, and comprises an insulating material 43 formed in the shape of a plate and wires 44 disposed therein at prescribed pitches. The ends of wires 44 are projecting from both sides of insulating material 43 so that both sides of board material 40 are electrically conducted.

Figure 16:
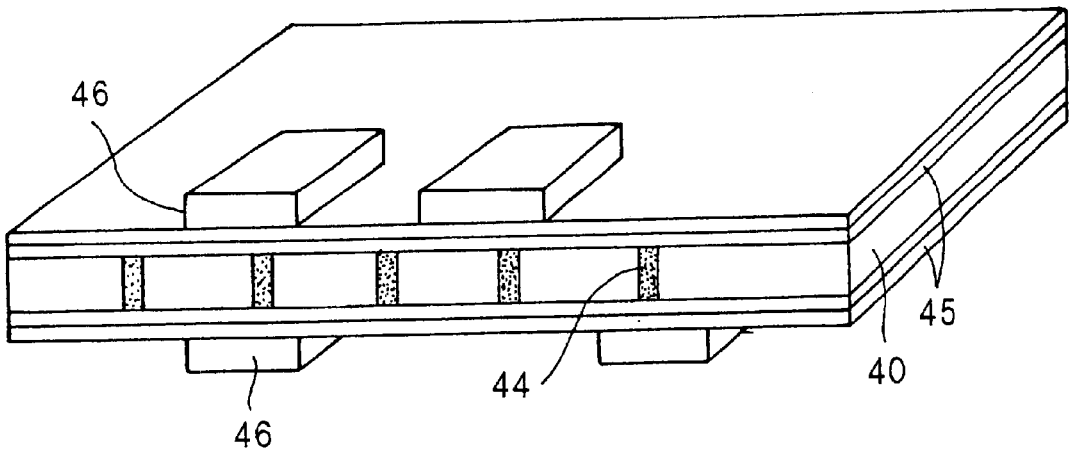
FIG. 16 is a perspective view illustrating an example of the printed circuit board.

The board material 40 having such a structure may be formed into a printed circuit board, for example as shown in FIG. 16, with a conductive layer (photo process layer) 45 having a prescribed circuit thereon, and a group of connection terminals 46 disposed on both sides.

The material used for conductive material will now be described.

In the present invention, a printed circuit board material or an anisotropic conductive material may be used as a conductive material. The constituting material may be any material such as rubber, plastic, glass, ceramic, etc., as far as it is an insulating material.

In the case where the conductive material is a printed circuit board material, an insulating material constituting the board material is preferably composed of plastic and ceramic, and is constructed in such a manner that ceramic particles, ceramic fibers or the like are dispersed into the matrix of plastic.

While the compounding quantity of both components may be selected adequately according to the characteristics such as an insulating property, low heat expansibility, abrasion resistance, and so on or the objectives thereof, it is preferable to contain from 40 volume % to 90 volume % of ceramic particles, ceramic fibers or the like considering that low heat expansibility and volumetric shrinkage due to hardening is small within this range.

In the insulating material of the present invention, since the volumetric shrinkage due to hardening may be 1% or less, or further 0.5% or less, it is quite advantageous for improvement of the dimensional accuracy of the wire in the board material.

By adjusting the compounding quantity in the range described above, low heat expansibility and abrasion resistance may be added effectively to the insulating material. If the content of ceramic particles or ceramic fibers exceeds 90 volume %, the content of plastic is insufficient which may result in loss of flow property during molding operation.

Ceramic includes glass such as quartz glass as well as alumina, zirconia, and nitriding silicon. Ceramic is mixed in the state of particles or fibers.

As plastic, any of thermoplastic resin and thermosetting resin may be used. Thermoplastic resin includes various resins such as vinyl chloride, polyethylene, polypropylene, polycarbonate, liquid quartz polymer, polyamide, polyimide or combination of two or more thereof.

On the other hand, as a thermosetting resin, phenol resin, epoxy resin, urea resin, or combination of two or more thereof may be used.

Preferably, the insulating material used for the board material described above is formed by mixing ceramics such as glass chips obtained by cutting glass fibers into a prescribed length or glass beads into plastic such as an epoxy resin or the like, since it has no anisotropy in thermal expansion and superior in insulating property, low heat expansibility, abrasion resistance, and strength.

As a material used for the wire to be disposed in the insulating material at prescribed pitches, any kind of metal having conductivity may be used. However, it is preferable to be any one of copper, copper alloy, aluminum, or aluminum alloy. In addition, considering abrasion resistance, flexibility, oxidation resistance, and strength, the wire is preferably made of beryllium copper. Industrial Applicability According to the method of three-dimensional wire alignment and the apparatus therefor, a wire structure having wires aligned three-dimensionally and accurately at prescribed pitches may be obtained. Since disposition of a guide block reduces the pressure applied to the spacer, deformation of the spacer may be prevented and multi-layer stacking and upsizing of the spacer may be performed easily. Since positioning of the spacer in the mold is facilitated and the spacer is provided with groove portions for receiving wires, the accuracy of wire positioning may be easily ensured. In addition, control of the wire feeding position by means of sliding mechanism, employment of a guide block, and control of the position of guide blocks enables a more efficient process for manufacturing wire structures while maintaining a tensile strength of the wire constant. As a result, a large sized wire structure with high dimensional accuracy may be manufactured with improved productivity. By using this wire structure, a printed circuit board material or an anisotropic conductive material may be manufactured.

What is claimed is:

1. A method of three-dimensional wire alignment for manufacturing a wire structure including wires aligned three-dimensionally at prescribed pitches, comprising the steps of:

providing at least one frame body having a prescribed thickness and having a central axis arranged radially perpendicular to a rotation axis of a rotary shaft;

winding a wire on said at least one frame body at prescribed pitches by rotating said rotary shaft about said rotation axis, wherein said wire contacts at least one surface of said at least one frame body; and stacking another frame body on said at least one frame body and winding a wire thereon at prescribed pitches to form a wire structure.

2. A method of three-dimensional wire alignment for manufacturing a wire structure including wires aligned three-dimensionally at prescribed pitches, comprising the steps of:

disposing two separator plates, each having a prescribed thickness, at positions parallel to and spaced from one another and parallel to and spaced from a rotation axis of a rotary shaft;

winding a wire on said two separator plates at a prescribed pitch by rotating said rotary shaft about said rotation axis; and stacking subsequent sets of separator plates on said two separator plates and winding a wire thereon at prescribed pitches to form a wire structure.

3. The method of three-dimensional wire alignment at set forth in claim 2, wherein at least one surface of each of said two separator plates has V-shaped grooves formed at prescribed pitches.

4. An apparatus for three-dimensional wire alignment, comprising:

a rotary shaft;

two side plates spaced apart and facing one another disposed along a direction perpendicular to a rotation axis of said rotary shaft;

two separator plates, each having a prescribed thickness, disposed at positions parallel to and spaced from one another and parallel to and spaced from said rotation axis;

driving means for rotating said two side plates and said two separator plates about said rotation axis; and a wire bobbin for feeding a wire to be wound from the outside of said two separator plates at prescribed pitches.

5. The apparatus for three-dimensional wire alignment as set forth in claim 4, wherein at least one end surface of each of said two separator plates has V-shaped grooves formed at prescribed pitches.

6. An apparatus for three-dimensional wire alignment, comprising:

a wire feeding mechanism;

a spacer;

a guide block for straining a wire;

a mold for mounting said spacer and said guide block; and a rotary mechanism for rotating said mold, wherein said spacer has groove portions formed therein at prescribed pitches and depths for arranging said wire on said spacer at prescribed pitches, and said guide block has notched portions formed therein at prescribed pitches for defining a straining position of the wire and supporting the tensile strength of the wire.

7. The apparatus for three-dimensional wire alignment as set forth in claim 6, wherein a distance between said spacers and said notched portions on said guide blocks increases as said spacers and said guide blocks are subsequently stacked.

8. The apparatus for three-dimensional wire alignment as set forth in claim 6, wherein said groove portions on each of a plurality of said spacers are substantially aligned with one another in a stacking direction of said spacers and said guide blocks stacked in multiple layers.

9. The apparatus for three-dimensional wire alignment as set forth in claim 6, wherein said notches on said guide blocks are provided with beveled portions corresponding to the straining angle of the wires for allowing the wires to only contact said notched portions of said guide blocks.

10. The apparatus for three-dimensional wire alignment as set forth in claim 6, wherein a bottom portion of each of said notches on said guide blocks has a profile having an obtuse angle or a curvature.

11. The apparatus for three-dimensional wire alignment as set forth in claim 6, wherein said wire feeding mechanism controls wire feeding positions by sliding in a direction parallel to a rotary shaft of said rotary mechanism and said mold.

12. The apparatus for three-dimensional wire alignment as set forth in claim 6, wherein said mold has a symmetric structure about a rotary shaft of said rotary mechanism.

13. A method for manufacturing a wire structure wherein said wire is strained three-dimensionally at prescribed pitches between grooved portions of a spacer and at pitches of the thickness of said spacer comprising the steps of:

(a) using a wire feeding mechanism, said spacer provided with said grooves for straining the wire by arranging it at prescribed pitches and at prescribed depths, a guide block provided with notched portions for defining a straining position of the wire and supporting the tensile strength of the wire formed at prescribed pitches, a mold for mounting said spacer and said guide block and a rotary mechanism for rotating said mold;

(b) rotating said mold while adjusting the feeding position of the wire from said wire feeding mechanism so that the wire is received in said prescribed notched portions on said guide blocks and said groove portions on said spacers;

(c) stacking said spacers and said guide blocks on said mold while suspending rotation of said mold instantaneously; and continuing steps (a)–(c) to form a wire structure.

14. The method of manufacturing a wire structure as set forth in claim 13, wherein said guide block is fixed to a side wall of at least one of a previously mounted guide block or mold.

15. The method of claim 13, further comprising the steps of:

pouring an insulating material into the wire structure;

curing said insulating material; and slicing said cured insulating material transversely of the wire.

16. The method for manufacturing a conductive material as set forth in claim 15, wherein said insulating material is selected from the group consisting of rubber, plastic, and plastic-ceramic composites.

17. A method of manufacturing a conductive material comprising the steps of:

providing at least one frame body having a prescribed thickness and having a central axis arranged radially perpendicular to a rotation axis of a rotary shaft;

winding a wire on said frame body at prescribed pitches by rotating said rotary shaft about said rotation axis, wherein said wire contacts at least one surface of said frame body;

stacking another frame body on said at least one frame body and winding a wire thereon at prescribed pitches to form a wire structure;

pouring an insulating material into the wire structure;

curing said insulating material; and slicing said cured insulating material transversely of the wire.

18. The method for manufacturing a conductive material as set forth in claim 17, wherein said insulating material is selected from the group consisting of rubber, plastic, and plastic-ceramic composites.

19. A method for manufacturing a conductive material comprising the steps of:

disposing two separator plates, each having a prescribed thickness, at positions parallel to and spaced from one another and parallel to and spaced from a rotation axis of a rotary shaft;

winding a wire on said two separator plates at a prescribed pitch by rotating said rotary shaft about said rotation axis;

stacking subsequent sets of separator plates on said two separator plates and winding a wire thereon at prescribed pitches to form a wire structure;

pouring an insulating material into the wire structure;

curing said insulating material; and slicing said cured insulating material transversely of the wire.

20. The method for manufacturing a conductive material as set forth in claim 19, wherein said insulating material is selected from the group consisting of rubber, plastic, and plastic-ceramic composites.

* * * * *